United States Patent [19]

Richeson et al.

[11] Patent Number: 4,942,852

[45] Date of Patent: Jul. 24, 1990

[54] ELECTRO-PNEUMATIC ACTUATOR

[75] Inventors: William E. Richeson; Frederick L. Erickson, both of Fort Wayne, Ind.

[73] Assignee: Magnavox Government and Industrial Electronics Company, Fort Wayne, Ind.

[21] Appl. No.: 294,729

[22] Filed: Jan. 6, 1989

[51] Int. Cl.[5] ..... F15B 11/08; F15B 13/04; F01B 11/02

[52] U.S. Cl. ..... 123/90.14; 123/90.12; 123/90.24; 91/459; 91/465; 92/85 B; 251/63.5; 137/625.64

[58] Field of Search ..... 123/90.11, 90.12, 90.14, 123/90.24; 137/625.64, 625.6; 91/459, 465; 92/85 B; 251/129.05, 129.21, 63.5

[56] References Cited

U.S. PATENT DOCUMENTS

| | | | |
|---|---|---|---|
| 4,582,082 | 4/1986 | Tosseghini | 251/63.5 |
| 4,741,364 | 5/1988 | Stoss et al. | 137/625.6 |
| 4,742,989 | 5/1988 | Akagi | 251/129.05 |
| 4,777,915 | 10/1988 | Bonvallet | 123/90.11 |
| 4,809,587 | 3/1989 | Kawahara et al. | 91/465 |

FOREIGN PATENT DOCUMENTS

| | | | |
|---|---|---|---|
| 197808 | 8/1978 | Fed. Rep. of Germany | 123/90.14 |

*Primary Examiner*—Charles J. Myhre

*Assistant Examiner*—Weilun Lo

*Attorney, Agent, or Firm*—Roger M. Rickert; Thomas A. Briody; Richard T. Seeger

[57] ABSTRACT

A bistable electronically controlled pneumatically powered transducer for use, for example, as a valve mechanism actuator in an internal combustion engine is disclosed. The transducer has a piston which is coupled to an engine valve, for example. The piston is powered by a pneumatic source and is held in each of its extreme positions, and air control valves are held in their closed positions by pressurized air and/or permanent magnet latching arrangements and the control valves are released therefrom to supply air to the piston, and the piston is released therefrom to be pneumatically driven to the other extreme position by an electromagnetic neutralization of the permanent magnet field. The piston forms a part of the magnetic latching circuit and that magnetic circuit also includes a radially slotted ferromagnetic member to both complete the magnetic circuit and provide a good air communication path from a high pressure air inlet to the control valve. A pair of auxiliary pistons movable with the piston compress air to a pressure above the pressure of the pneumatic source for aiding reclosure of the control valves as well as aiding maintenance of those control valves in their closed positions thereby reducing the size and cost of the latching permanent magnets.

11 Claims, 7 Drawing Sheets

ELECTRO-PNEUMATIC ACTUATOR

SUMMARY OF THE INVENTION

The present invention relates generally to a two position, straight line motion actuator and more particularly to a fast acting actuator which utilizes pneumatic as well as magnetic force to propel a ferromagnetic piston to perform fast transit times between the two positions. The invention utilizes a pair of control valves to gate high pressure air to the piston and permanent magnets to hold the control valves in their closed positions until a coil is energized to neutralize the permanent magnet latching force and open one of the valves. Stored pneumatic gases and a magnetic field accelerate the piston rapidly from one position to the other position. Movement of the piston away from the one position toward the other increases the reluctance of the magnetic path associated with the permanent magnet which was holding the control valve closed. The permanent magnets function not only to latch the control valves closed, but also to hold the piston in the current one of its two bistable positions. An additional damping of piston motion and retrieval of portion of the kinetic energy of the piston is accomplished by an auxiliary piston which moves with the main or working piston and compresses air to help reclose the control valve.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

For example, in U.S. patent application Ser. No. 226,418 entitled VEHICLE MANAGEMENT COMPUTER filed in the name of William E. Richeson on July 29, 1988 there is disclosed a computer control system which receives a plurality of engine operation sensor inputs and in turn controls a plurality of engine operating parameters including ignition timing and the time in each cycle of the opening and closing of the intake and exhaust valves among others U.S. Pat. No. 4,009,695 discloses hydraulically actuated valves in turn controlled by spool valves which are themselves controlled by a dashboard computer which monitors a number of engine operating parameters. This patent references many advantages which could be achieved by such independent valve control, but is not, due to its relatively slow acting hydraulic nature, capable of achieving these advantages. The patented arrangement attempts to control the valves on a real time basis so that the overall system is one with feedback and subject to the associated oscillatory behavior.

In copending application Ser. No. 021,195, now U.S. Pat. No. 4,794,890, entitled ELECTROMAGNETIC VALVE ACTUATOR, filed Mar. 8, 1987 in the name of William E. Richeson and assigned to the assignee of the present application, there is disclosed a valve actuator which has permanent magnet latching at the open and closed positions. Electromagnetic repulsion may be employed to cause the valve to move from one position to the other. Several damping and energy recovery schemes are also included.

In copending application Ser. No 153,257, now U.S. Pat. No. 4,878,464, entitled PNEUMATIC ELECTRONIC VALVE ACTUATOR, filed Feb. 8, 1988 in the names of William E. Richeson and Frederick L. Erickson and assigned to the assignee of the present application there is disclosed a somewhat similar valve actuating device which employs a release type mechanism rather than a repulsion scheme as in the previously identified copending application. The disclosed device in this application is a jointly pneumatically and electromagnetically powered valve with high pressure air supply and control valving to use the air for both damping and as one motive force. The magnetic motive force is supplied from the magnetic latch opposite the one being released and this magnetic force attracts an armature of the device so long as the magnetic field of the first latch is in its reduced state. As the armature closes on the opposite latch, the magnetic attraction increases and overpowers that of the first latch regardless of whether it remains in the reduced state or not. This copending application also discloses different operating modes including delayed intake valve closure and a six stroke cycle mode of operation.

In copending application Ser. No. 153,155 filed Feb. 8, 1988 in the names of William E. Richeson and Frederick L. Erickson, assigned to the assignee of the present application and entitled PNEUMATICALLY POWERED VALVE ACTUATOR there is disclosed a valve actuating device generally similar in overall operation to the present invention. One feature of this application is that control valves and latching plates have been separated from the primary working piston to provide both lower latching forces and reduced mass resulting in faster operating speeds. This concept is incorporated in the present invention and it is one object of the present invention to further improve these two aspects of operation.

Copending application Ser. Nos. 209,273, now U.S. Pat. No. 4,873,948, and 209,279, now U.S. Pat. No. 4,852,528, entitled respectively PNEUMATIC ACTUATOR WITH SOLENOID OPERATED CONTROL VALVES and PNEUMATIC ACTUATOR WITH PERMANENT MAGNET CONTROL VALVE LATCHING, filed in the names of William E. Richeson and Frederick L. Erickson, assigned to the assignee of the present invention and both filed on June 20, 1988 address, among other things, the use of air pressure at or below source pressure to aid in closing and maintaining closed the control valves along with improvements in operating efficiency over the above noted devices.

Other related applications all assigned to the assignee of the present invention and filed in the name of William E. Richeson on Feb. 8, 1988 are Ser. No. 07/153,262, now U.S. Pat. No. 4,883,025, entitled POTENTIAL-MAGNETIC ENERGY DRIVEN VALVE MECHANISM where energy is stored from one valve motion to power the next and where a portion of the motive force for the device comes from the magnetic attraction from a latch opposite the one being currently neutralized as in the abovenoted Ser. No. 153,257; and Ser. No. 07/153,154, now U.S. Pat. No. 4,831,973, entitled REPULSION ACTUATED POTENTIAL ENERGY DRIVEN VALVE MECHANISM wherein a spring (or pneumatic equivalent) functions both as a damping device and as an energy storage device ready to supply part of the accelerating force to aid the next transition from one position to the other.

In Applicants' U.S. Pat. No. 4,875,441, filed in the names of Richeson and Erickson, the inventors herein, on even date herewith and entitled ENHANCED EFFICIENCY VALVE ACTUATOR, there is disclosed a pneumatically powered valve actuator which has a pair of air control valves with permanent magnet latching of those control valves in closed position. The magnetic latching force (and therefor, the size/cost) of the latching magnets is reduced by equalizing air pressure on the control valve which heretofor had to be overcome by the magnetic attraction. Damping requirements for the main reciprocating piston are reduced because there is a recapture and use of the kinetic energy of the main piston to reclose the control valve. The main piston shaft has 0-ring sealed "bumpers" at each end to drive the air control valve closed should it fail to close otherwise.

In Applicants' U.S. Pat. No. 4,872,425, filed in the names of Richeson and Erickson on even date herewith and entitled AIR POWERED VALVE ACTUATOR, the reciprocating piston of a pneumatically driven valve actuator has several air passing holes extending in its direction of reciprocation to equalize the air pressure at the opposite ends of the piston. The piston also has an undercut which, at the appropriate time, passes high pressure air to the back side of the air control valve thereby using air being vented from the main piston of the valve to aid in closing the control valve. The result is a higher air pressure closing the control valve than the air pressure used to open the control valve.

In Applicants' application Ser. No. 295,177, filed in the names of Richeson and Erickson on even date herewith and entitled FAST ACTING VALVE there is disclosed a valve actuating mechanism having a pair of auxiliary pistons which aid in reclosing air control valves while at the same time damping main piston motion near the end of the mechanism travel.

In Applicants' application Ser. No. 294,727, filed in the names of Richeson and Erickson on even date herewith and entitled PNEUMATIC ACTUATOR, an actuator has one-way pressure relief valves similar to the relief valves in the abovementioned Ser. No. 209,279 to vent captured air back to the high pressure source. The actuator also has "windows" or venting valve undercuts in the main piston shaft which are of reduced size as compared to the windows in other of the cases filed on even date herewith resulting in a higher compression ratio. The actuator of this application increases the area which is pressurized when the air control valve closes thereby still further reducing the magnetic force required.

In Applicants' application Ser. No. 295,178, filed in the names of Richeson and Erickson on even date herewith and entitled COMPACT VALVE ACTUATOR, the valve actuator cover provides a simplified air return path for low pressure air and a variety of new air venting paths allow use of much larger high pressure air accumulators close to the working piston.

All of the above noted cases filed on even date herewith have a main or working piston which drives the engine valve and which is, in turn powered by compressed air. The power or working piston which moves the engine valve between open and closed positions is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by an electrical pulse in a coil near the permanent magnet. All of the cases employ "windows" which are cupped out or undercut regions on the order of 0.1 inches in depth along a somewhat enlarged portion of the shaft of the main piston, for passing air from one region or chamber to another or to a low pressure air outlet. These cases may also employ a slot centrally located within the piston cylinder for supplying an intermediate latching air pressure as in the abovenoted Ser. No. 153,155 and a reed valve arrangement for returning air compressed during piston damping to the high pressure air source as in the abovenoted Ser. No. 209,279.

The entire disclosures of all of the above identified copending applications are specifically incorporated herein by reference.

Among the several objects of the present invention may be noted the provision of a bistable fluid powered actuating device characterized by fast transition times and improved efficiency; the provision of a jointly electromagnetically and pneumatically driven actuating device having more rapidly reacting control valves; the provision of an electronically controlled pneumatically powered valve actuating device having auxiliary pistons which aid both damping and reclosure of control valves; the provision of an electronically controlled pneumatically powered valve actuating device having common permanent magnet latching for both a control valve and the main piston; the provision of an electronically controlled pneumatically powered valve actuating device in accordance with the previous object wherein motion of either the control valve or the piston causes a reduction in the magnetic force holding the other; the provision of a valve actuating device having air supply control valves and air chambers which retain and compress air during the time the control valves are opening which compressed air acts as an air spring to aid reclosing of the air control valves; and the provision of a valve actuating device having fast response air control valves. These as well as other objects and advantageous features of the present invention will be in part apparent and in part pointed out hereinafter.

In general, a subpiston segment of the main piston slidingly engages the inside bore of the air control valve as the air valve opens. The high pressure air and the magnetic attraction of the main piston by an unexcited permanent magnet latch accelerating the main piston causes the subpiston to compress air in an annular chamber and the increased pressure in that chamber aids reclosing of the air control valve. The actuator reduces the air demand on the high pressure air source by recovering as much as possible of the air which is compressed during damping. The main piston provides a portion of the magnetic circuit which holds the air control valves closed. When a control valve is opened, the control valve and the main piston both move and the reluctance of the magnetic circuit increases dramatically and the magnetic force attracting the control valve is correspondingly reduced. As noted earlier, this allows the magnetic force of an opposite (remote) magnetic circuit to attract the main piston Also in general and in one form of the invention, a bistable electronically controlled fluid powered transducer has an air powered piston which is reciprocable along an axis between first and second positions along with a control valve reciprocable along the same axis between open and closed positions. A magnetic latching arrangement functions to hold the control valve in the closed position and the piston in either of its bistable states while an electromagnetic arrangement may be energized to temporarily override the effect of the latching arrangement to release the control valve to move from the closed position to the open position and the piston to be acted upon by high pressure air and the magnetic attractive force of the opposite (unenergized) latch. Energization of the electromagnetic arrangement causes movement of the control valve in one direction along the axis allowing fluid from a high pressure source to enter the closed chamber and drive the piston in the opposite direction from the first position to the second position along the axis. Piston motion compresses air in a separate chamber for subsequently forcing the control valve back to a closed position.

Still further in general and in one form of the invention, a pneumatically powered valve actuator includes a valve actuator housing with a piston reciprocable inside the housing along an axis. The piston has a pair of oppositely facing primary working surfaces. A pair of air control valves are reciprocable along the same axis relative to both the housing and the piston between open and closed positions. A magnetic latching arrangement holds the control valves in their closed positions and also holds the piston in either of its extreme positions. A coil is electrically energized to selectively open one of the air control valves to supply pressurized air to one of the primary working surfaces causing the piston to move. Energization of the coil also temporarily relieves the magnetic attraction acting on the piston and the combination of piston and control valve motion away from the magnetic latching arrangement significantly reduces the magnetic attractive force on both the piston and the control valve. Closure of the air control valve is aided by air which has been compressed by motion of the piston. Such compression may be effected by auxiliary pistons at opposite ends of the piston which may compress air to a pressure above the pressure of the air driving the main piston.

BRIEF DESCRIPTION OF THE DRAWING

Corresponding reference characters indicate corresponding parts throughout the several views of the drawing.

Figure 1:
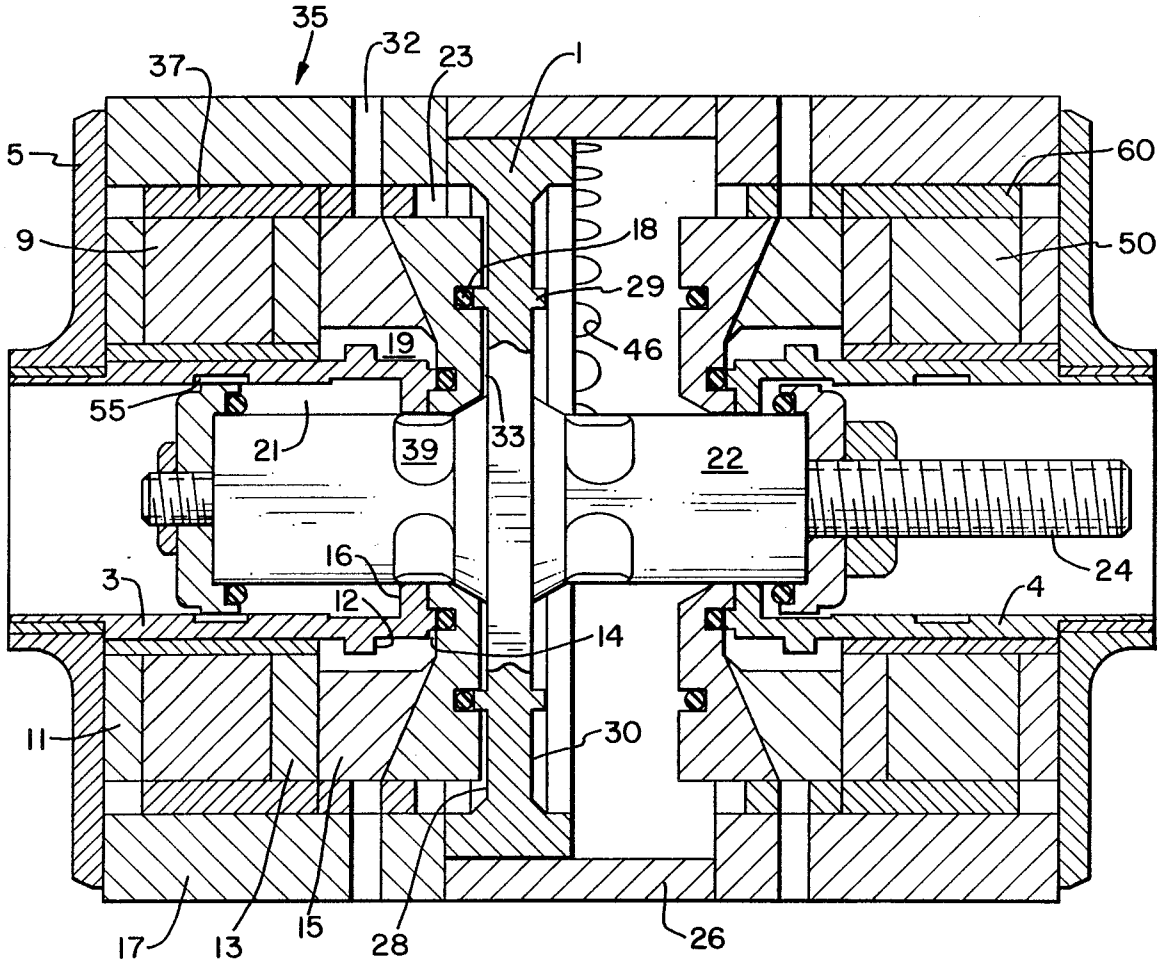
FIG. 1 is a view in cross-section showing the pneumatically powered actuator of the present invention with the power piston latched in its leftmost position as it would normally be when the corresponding engine valve is closed.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The valve actuator is illustrated sequentially in FIGS. 1–7 to illustrate various component locations and functions in moving a poppet valve or other component (not shown) from a closed to an open position. Motion in the opposite direction will be clearly understood from the symmetry of the components. Generally speaking, a pneumatically powered valve actuator is shown having a valve actuator housing 26 and a piston 22 reciprocable within the housing along the axis of the shaft or stem 24. The piston 22 has a pair of oppositely facing primary working surfaces 28 and 30, which respond to a pressurized air source 82 under the control of a pair of air control valves 3 and 4 reciprocable along the axis relative to both the housing 26 and the piston 22 between open and closed positions. A magnetic neutralization coil 37 or 60 may be energized to neutralize the latching effect of a permanent magnet 9 or 50 respectively for selectively opening one of the air control valves 3 or 4 to supply pressurized air from the air source 32 by way of chamber such as 19 and window such as 89 to one of said primary working surfaces causing the piston to move. When the effect of, e.g., magnet 9 is neutralized or at least significantly reduced, magnet 50 dominates and there is a differential magnetic force acting on the piston urging it toward the right as viewed.

The actuator includes a shaft or stem 24 which may form a part of or connect to an internal combustion engine poppet valve. The actuator also includes a reciprocable piston 22, and a pair of reciprocating or sliding control valve members 8 and 4 enclosed within the housing 26. The control valve members 3 and 4 are latched in a closed position by the attractive forces of magnets 9 and 50, and may be dislodged from their respective latched positions by energization of coils 87 and 60. The control valve members or shuttle valves 3 and 4 cooperate with both the piston 22 and the housing 26 to achieve the various porting functions during operation. The housing 26 has a high pressure inlet port 82 and low pressure outlet port 46 as well as low pressure outlet through the open ends of the housing. The low pressure may be about atmospheric pressure while the high pressure is on the order of 90-14 100 psi. gauge pressure.

FIG. 1 shows the actuator piston 1 to the extreme left position with the air valve 3 held in an off or disabled condition by the armature or pole piece 5 and latch assembly 35 because of the magnetic attraction of axially poled annular permanent magnet 9 and its magnetic circuit including ferromagnetic pieces 11, 13 and 15, the housing 17 and the piston 1. The adjacent portions of the structure not participating in this magnetic circuit are typically aluminum or other nonmagnetic material. The piston 1 forms a part of the magnetic latching circuit and that magnetic circuit also includes a radially slotted ferromagnetic member 15 to both complete the magnetic circuit and provide a good air communication path from a high pressure air inlet 32 to the control valve 8. Thus, the air control valve 8 is magnetically held closed against the opposing force due to the high air pressure in cavity 19 acting on face 14. The opposing pressure in cavity 21 acting on face 16 is currently atmospheric.

Cavity 23 is at an elevated pressure due to retained air from a previous excursion of the piston 1 toward the left as viewed. Piston 1 is made from a ferromagnetic material and, since it forms a portion of the magnetic circuit, is held in the position shown by permanent magnet 9. The force of the magnetic attraction exceeds the repulsive force of the air in cavity 23. This repulsive force acts on the annular area 31 radially outside the "0" ring seal 18 of the piston face while the air pressure acting on the inner face portion 33 is essentially atmospheric pressure. There is an air path through window 39, annular chamber 21 and the undercut slots 55 to the atmosphere.

Figure 2:
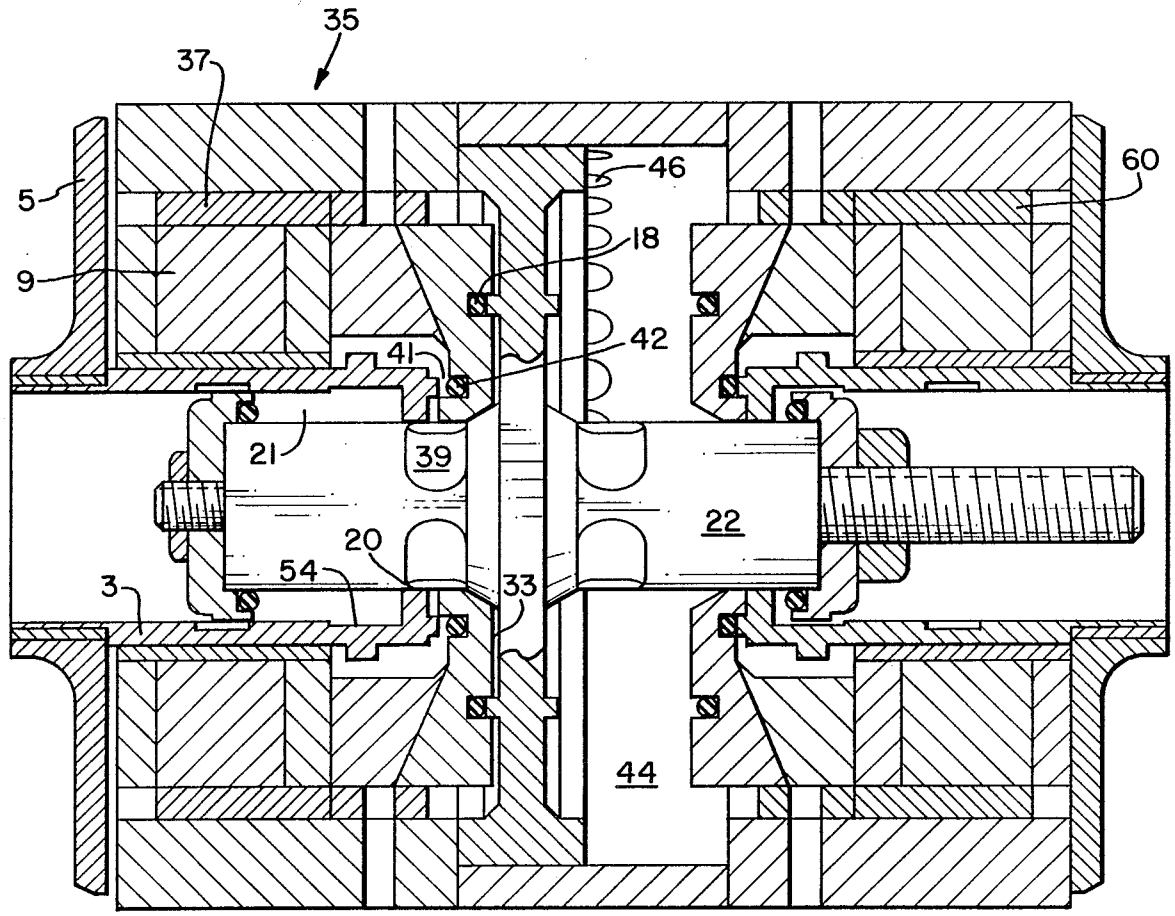
FIGS. 2–7 are views in cross-section similar to FIG. 1, but illustrating component motion and function as the piston progresses rightwardly to its extreme rightward or valve open position.

In FIG. 2, the magnetic latch assembly 35 is actuated by a pulse of electrical current through coil 37 which temporarily neutralizes the field of permanent magnet 9 to free the armature or pole piece 5 and the air control valve 3 to which it is connected allowing the air control valve to move toward the left opening the air valve. This motion of the pole piece 5 increases the reluctance of the magnetic circuit and further reduces the magnetic latch field. High pressure air from cavity 19 passes through the recently opened aperture 41 at "0" ring 42 and, by way of window 39, enters the inner area 33 adjacent the working face of piston 1. Note that as the air control valve 3 moves toward the left, the window 39 is cut off from chamber 21 by the radially inner surface 20. This high air pressure in area 33 overcomes the magnetic attractive force on the piston 1 and the piston moves toward the right as sequentially depicted in FIGS. 3–7. Note that chamber 44 is at atmospheric pressure due to the vent hole 46 to atmosphere.

Figure 3:
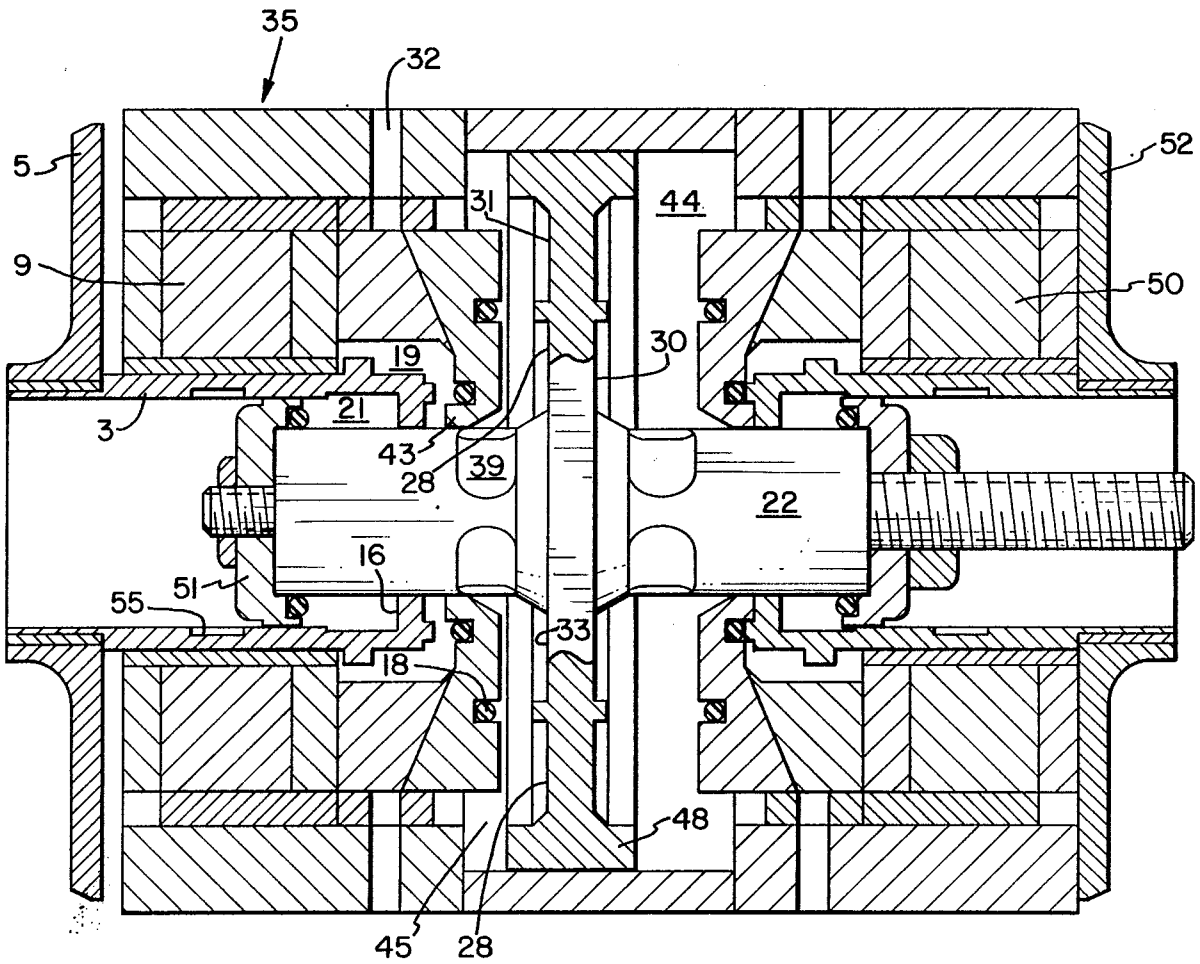

Between FIGS. 2 and 3, the "0" ring 18 seal is broken and high pressure air is applied to the entire face of the piston. FIG. 3 shows the piston has moved sufficiently far that the air flow from chamber 19 through window 39 is now cut off by abutment 43. Thereafter, the air in cavity 45 expands (but is not replenished) pushing the piston toward the right. The enlarged foot 48 seals the atmospheric vent 46 and pressure begins to build in chamber 44 tending to retard rightward motion of the piston 1. At the same time the expanding air in chamber 45 and the attraction of permanent magnet 50 urges the piston toward the right. Note that the magnet 50 has a greater effect on the piston than does the magnet 9 because pole piece 5 is still separated from the remaining magnetic circuit of latch 35 significantly increasing the reluctance of that magnetic circuit, while pole piece 52 has closed the magnetic circuit of the right hand latch. Further piston deceleration or damping comes from the building pressure in cavity 21. The combined motions of piston 1 and air control valve 3 have spaced the subpiston 51 from the aperture or slot 55 and the annular chamber 21 is now sealed and decreasing in volume. This building pressure acts on face 16 forcing the air control valve back toward its closed position as well as retarding the piston 1.

Figure 4:
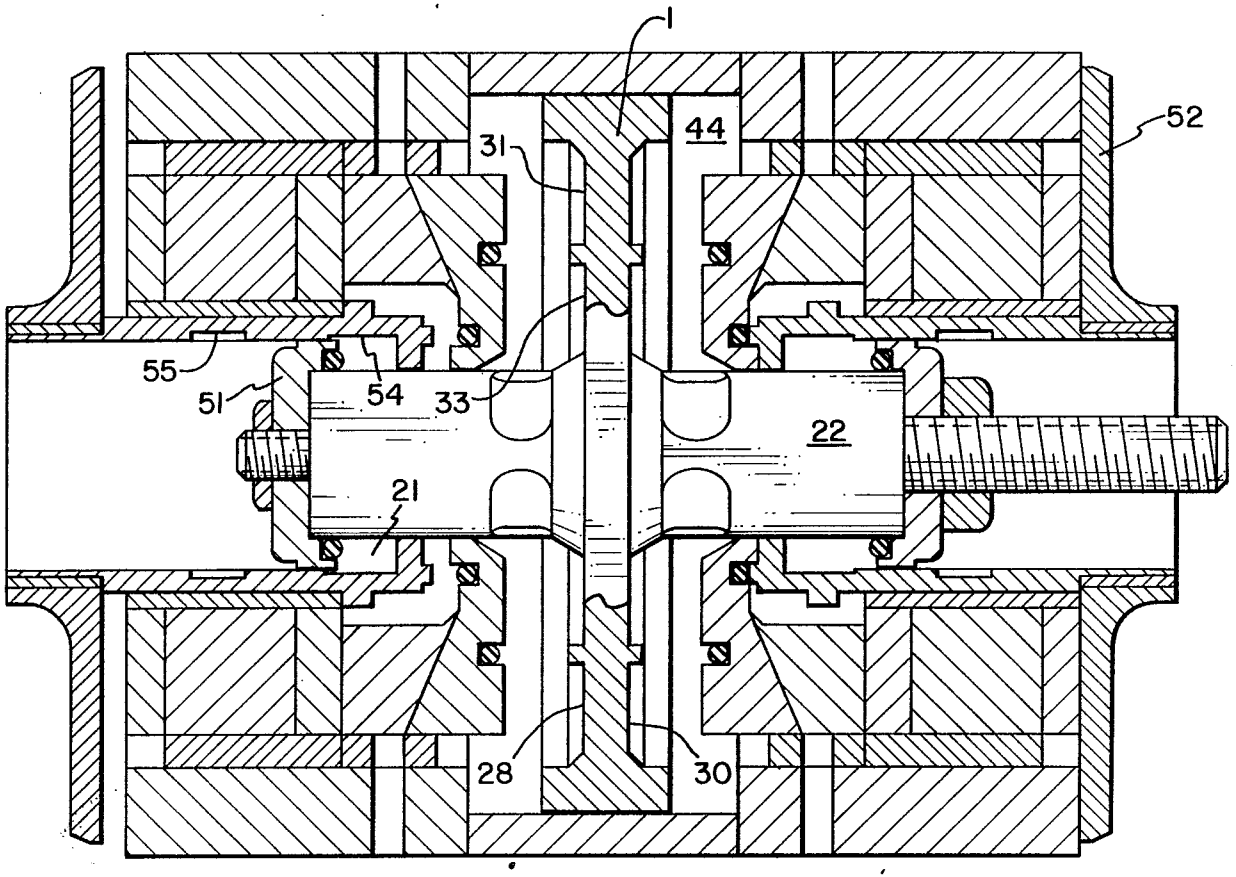
Figure 5:
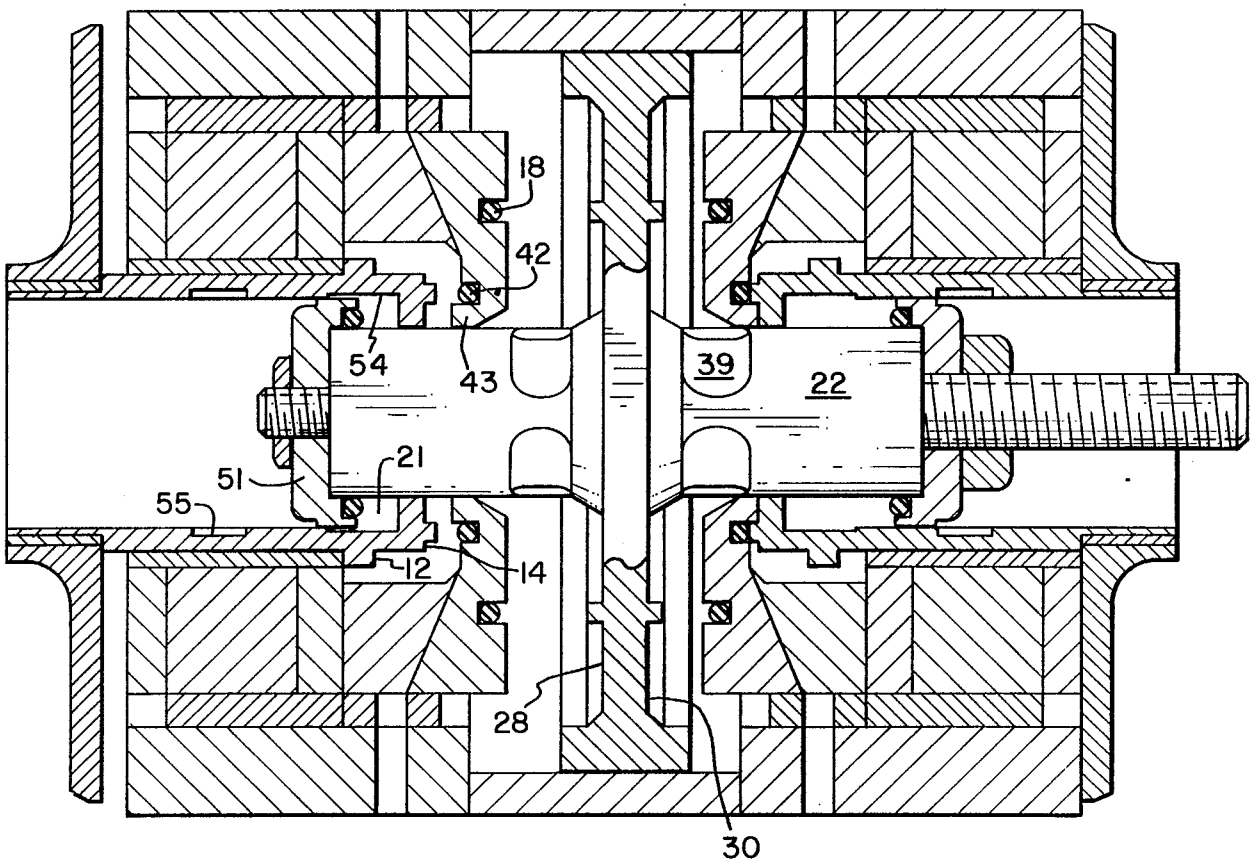

FIGS. 4 and 5 illustrate continued motion of the piston toward the right.

Figure 6:
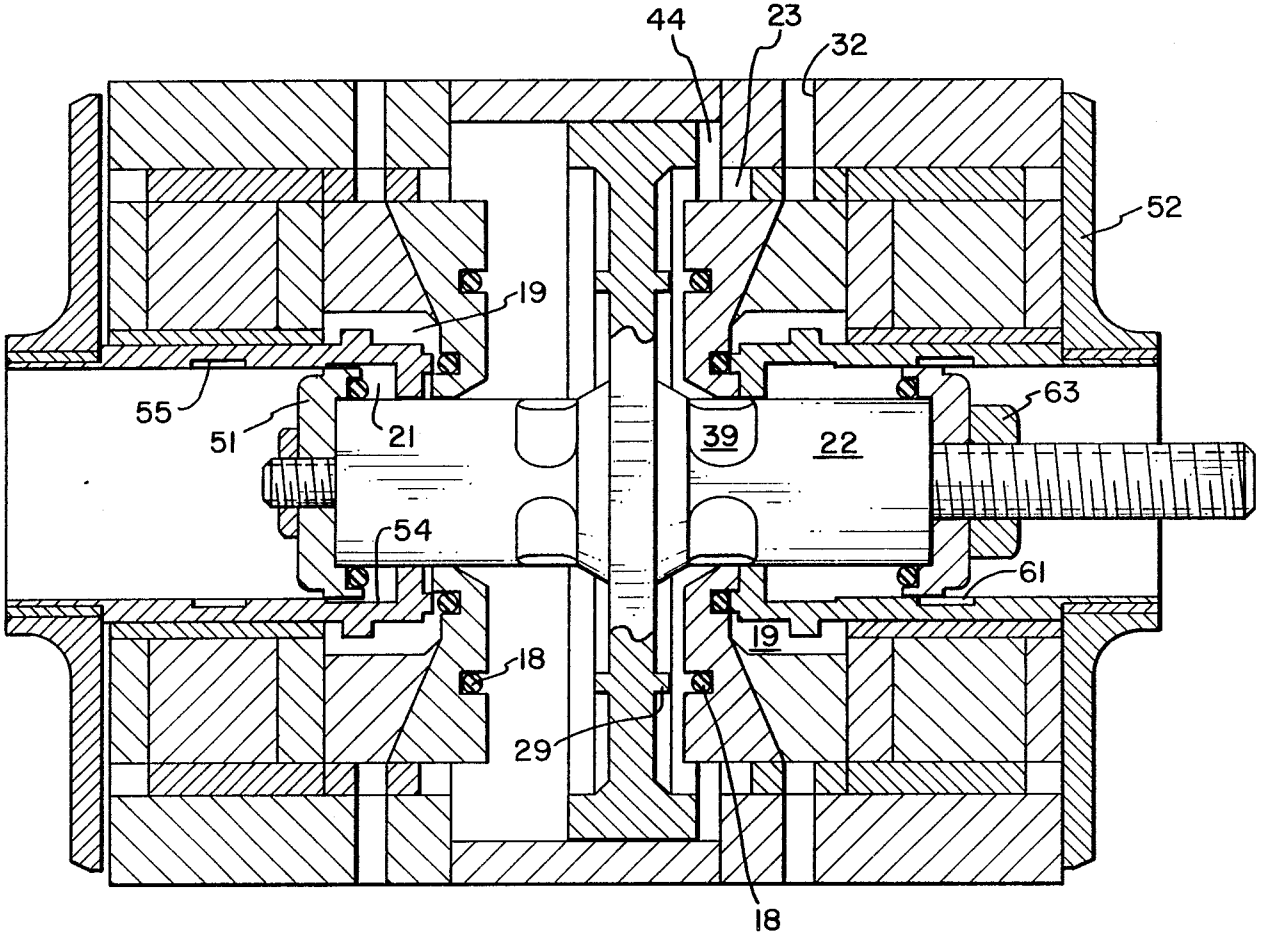

In FIG. 6, the subpiston 61 is just clearing the edge of the shallow undercut 54 allowing the built up pressure in chamber 21 to escape out the open end of the actuator to atmosphere, however, the pressure in cavity 44 is still building, further slowing piston motion. The pressure in cavity 44 may exceed that of the high pressure source in cavity 19 in which case, a reed valve arrangement in the radially outer portion of cavity 44 as in the above noted copending Ser. No. 209,279 may be employed for recovering a percentage of the kinetic energy of the piston. Of course, the chamber 28 also recovers and stores a percentage of the piston energy.

Figure 7:
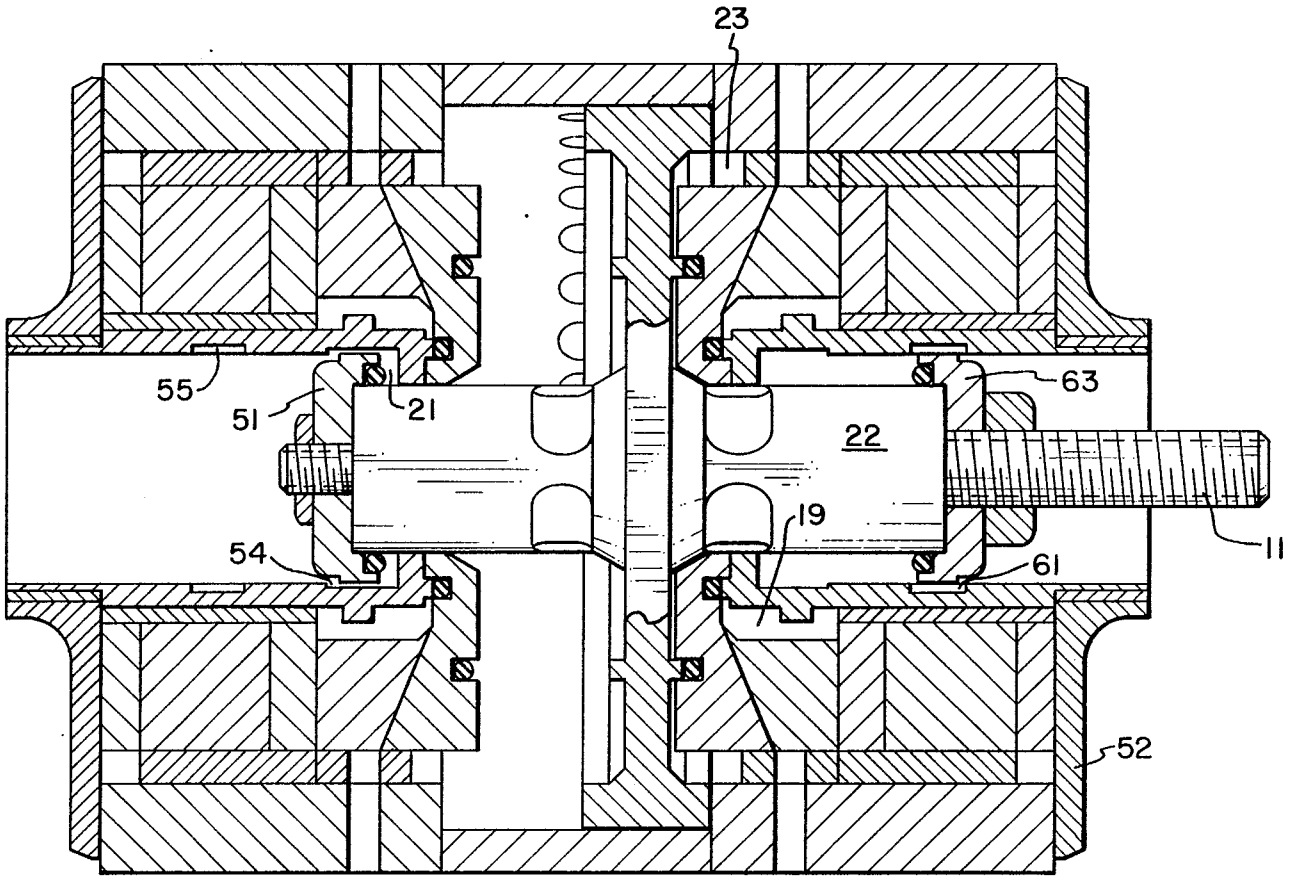

As the piston continues its rightward travel, annular tang 29 engages the "0" ring seal 18 dividing the cavity 44 into two parts. FIG. 7 shows the piston in its extreme right hand position. At this position, the radially outer part stores pressurized air in cavity 23 much as an air spring biasing the piston preparatory for the next valve transition. The radially inner part vents air through window 89, and past the subpiston 68 through slot 61 out the actuator end to atmosphere. As used herein, "vented to atmosphere" and similar language is intended to include the preferred situation where the low pressure outlet is at substantially atmospheric pressure and the outlet air is recirculated and compressed in a closed system. The timing of this venting is such as to gently damp piston motion and then release a part of the air being compressed very near the end of piston travel.

It will be understood from the symmetry of the valve actuator that the behavior of the air control valves 3 and 4 in utilizing main piston energy for additional valve reclosure force is, as are many of the other features, substantially the same near each of the opposite extremes of the piston travel. It will also be recognized that pistons 51 and 63 may include "0" rings which may function as bumpers to drive the air control valves closed should they fail to otherwise close as in the above mentioned U.S. Pat. No. 4,875,441.

Little has been said about the internal combustion engine environment in which this invention finds great utility. That environment may be much the same as disclosed in the abovementioned copending applications and the literature cited therein to which reference may be had for details of features such as electronic controls and air pressure sources. In this preferred environment, the mass of the actuating piston and its associated coupled engine valve is greatly reduced as compared to the prior devices. While the engine valve and piston move about 0.45 inches between fully open and fully closed positions, the control valves move only about 0.125 inches therefor requiring less energy to operate. The air passageways in the present invention are generally large annular openings with little or no associated throttling losses.

From the foregoing, it is now apparent that a novel electronically controlled, electro-pneumatically powered actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A bistable electro-pneumatic transducer having a piston reciprocable along an axis between first and second positions; a source of high pressure air; a selectively enableable control valve having an enabled position for selectively supplying high pressure air to the piston to move the piston from one of said positions to the other; a permanent magnet latching arrangement for maintaining the control valve in a disabled position and for holding the piston in the corresponding one of the first and second positions; electromagnetic means for temporarily neutralizing the latching arrangement to release the control valve to move from the disabled position to the enabled position; energization of the electromagnetic means causing movement of the control valve in one direction along the axis and applying high pressure fluid to a portion of the piston to drive the piston in the opposite direction from one position to the other position along the axis.

2. The bistable transducer of claim 1 further comprising means responsive to piston movement for returning the control valve to the disabled position.

3. The bistable transducer of claim 1 wherein the means responsive to piston movement comprises an annular cylinder having an auxiliary piston fixed to and movable with the piston closing one end and a portion of the valve closing the other end.

4. The bistable transducer of claim 1 wherein the control valve includes a ferromagnetic pole piece which forms a part of the magnetic circuit of the permanent magnet latching arrangement when the control valve is in the disabled position.

5. The bistable transducer of claim 1 wherein the piston includes a ferromagnetic pole piece which forms a part of the magnetic circuit of the permanent magnet latching arrangement when the control valve is in the disabled position.

6. The bistable transducer of claim 5 wherein the control valve includes a ferromagnetic pole piece which forms a part of the magnetic circuit of the permanent magnet latching arrangement when the control valve is in the disabled position, the ferromagnetic pole pieces of the piston and of the control valve moving away from one another and significantly increasing the reluctance of the magnetic circuit of the permanent magnet latching arrangement when the electromagnetic means temporarily neutralizes the-latching arrangement to release the control valve to move from the disabled position to the enabled position.

7. The bistable transducer of claim 1 wherein the permanent magnet latching arrangement includes an axially polarized annular permanent magnet.

8. A pneumatically powered valve actuator comprising a valve actuator housing; a main piston reciprocable within the housing along an axis; a pair of auxiliary pistons fixed to and movable with the main piston, the main piston having a pair of oppositely facing primary working surfaces; a pressurized air source; a pair of air control valves reciprocable along said axis relative to both the housing and the main piston between open and closed positions; means for magnetically capturing the main piston at either of its extreme positions and means for selectively opening one of said air control valves to supply pressurized air from the air source to one of said primary working surfaces causing the main piston and the pair of auxiliary pistons to move, the means for selectively opening also being effective to release the means for magnetically capturing the main piston.

9. A pneumatically powered valve actuator comprising a valve actuator housing; a ferromagnetic piston reciprocable within the housing along an axis, the piston having a pair of oppositely facing primary working surfaces which define, in conjunction with the housing, a pair of working chambers; a pressurized air source; a pair of air control valves reciprocable along said axis relative to both the housing and the piston between open and closed positions; a magnetic latching circuit for holding at least one of the air control valves in a closed position; means for selectively opening the other of said air control valves to both supply pressurized air from the air source to one of said working chambers and permit the magnetic latching circuit to exert an attractive force on the piston, causing the piston to move; and pneumatic means utilizing the other of the working chambers for decelerating the piston near the extremities of its reciprocation and converting a portion of the piston kinetic energy to potential energy in the form of compressed air to aid the next movement of the piston.

10. The pneumatically powered valve actuator of claim 9 wherein the piston includes an axially extending annular projection which cooperates with the housing as the piston nears an extreme of its movement to subdivide the working chamber into two separate chambers, one chamber being vented to atmosphere and the other being sealed and storing the compressed air to aid the next movement of the piston.

11. The pneumatically powered valve actuator of claim 9 wherein the piston forms a part of the magnetic latching circuit, the magnetic circuit further including a radially slotted ferromagnetic member to both complete the magnetic circuit and provide a good air communication path from the pressurized air source to the air control valve.

* * * * *